US007021627B2

(12) United States Patent
Sargent et al.

(10) Patent No.: US 7,021,627 B2
(45) Date of Patent: Apr. 4, 2006

(54) GAME WITH MEMENTOS AND DESTINY INDEX

(75) Inventors: Mark Sargent, Glendale, CA (US); Lucy Schultz, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/742,460

(22) Filed: Dec. 18, 2003

(65) Prior Publication Data

US 2004/0239030 A1 Dec. 2, 2004

Related U.S. Application Data

(60) Provisional application No. 60/434,566, filed on Dec. 18, 2002.

(51) Int. Cl.
*A63F 3/00* (2006.01)

(52) U.S. Cl. ..... 273/243; 273/248

(58) Field of Classification Search ..... 273/243, 273/250, 253, 261
See application file for complete search history.

(56) References Cited

U.S. PATENT DOCUMENTS 53,561 A 4/1866 Bradley
2,549,495 A * 4/1951 Lightfoot et al. ..... 273/248
3,759,521 A 9/1973 Breslow et al.
3,951,411 A * 4/1976 Hill et al. ..... 273/243
4,359,226 A 11/1982 Neff
4,893,819 A 1/1990 Wright
4,955,616 A 9/1990 Ingalls
5,306,007 A * 4/1994 Scuteri ..... 273/161
5,407,207 A 4/1995 Stanford
5,451,061 A 9/1995 DeLesio et al.
5,478,086 A 12/1995 Aylett
5,876,211 A 3/1999 Schmoyer et al.
5,931,469 A 8/1999 Stichnoth
6,019,370 A 2/2000 Morris
6,267,375 B1 7/2001 Bernstein et al.
6,299,168 B1 10/2001 Tyson
6,315,292 B1 * 11/2001 Howlett et al. ..... 273/236

* cited by examiner

*Primary Examiner*—Vishu K. Mendiratta
(74) *Attorney, Agent, or Firm*—Kolisch Hartwell, P.C.

(57) ABSTRACT

The invention comprises a board game in which each player moves a playing piece along a continuous path, where the moves are determined by, for example, a roll of one or more dice. The path may be subdivided into spaces, some of which may require various actions by the players. These actions may result in the player accumulating an item. At the conclusion of the game, the tokens possessed by each player may be used to determine a possible fate, fortune, or destiny, for that player.

16 Claims, 1 Drawing Sheet

GAME WITH MEMENTOS AND DESTINY INDEX

CROSS REFERENCE TO RELATED APPLICATIONS

The present invention claims priority to U.S. Provisional Application Ser. No. 60/434,566, filed on Dec. 18, 2002, the disclosure of which is incorporated by reference in its entirety for all purposes.

FIELD OF THE INVENTION

The present invention relates generally to board games, and more specifically to board games with items, or mementos, that are collected to determine a corresponding characteristic of a player. For example, the outcome of the game, including the particular items collected, may be used to determine a "future destiny" for each player, as a type of pretend fortune teller. The invention also includes various rules and apparatii for playing a board game, including games where each player accumulates items as the player answers questions during play.

BACKGROUND OF THE INVENTION

Disclosures of games where items are collected to determine a characteristic of a player are found in U.S. Pat. Nos. 4,359,226 and 4,893,819. Disclosure of a game where a prediction of a player's future destiny is an outcome of the game is found in U.S. Pat. No. 6,299,168. The disclosures of each of these patents are incorporated herein by reference.

SUMMARY OF THE INVENTION

The invention comprises a board game in which each player moves a playing piece along a continuous path, where the moves are determined by, for example, a roll of one or more dice. The path may be subdivided into spaces, some of which may require various actions by the players. These actions may result in the player accumulating an item. At the conclusion of the game, the tokens possessed by each player may be used to determine a possible fate, fortune, or destiny, for that player.

DETAILED DESCRIPTION OF THE INVENTION

Figure 1:
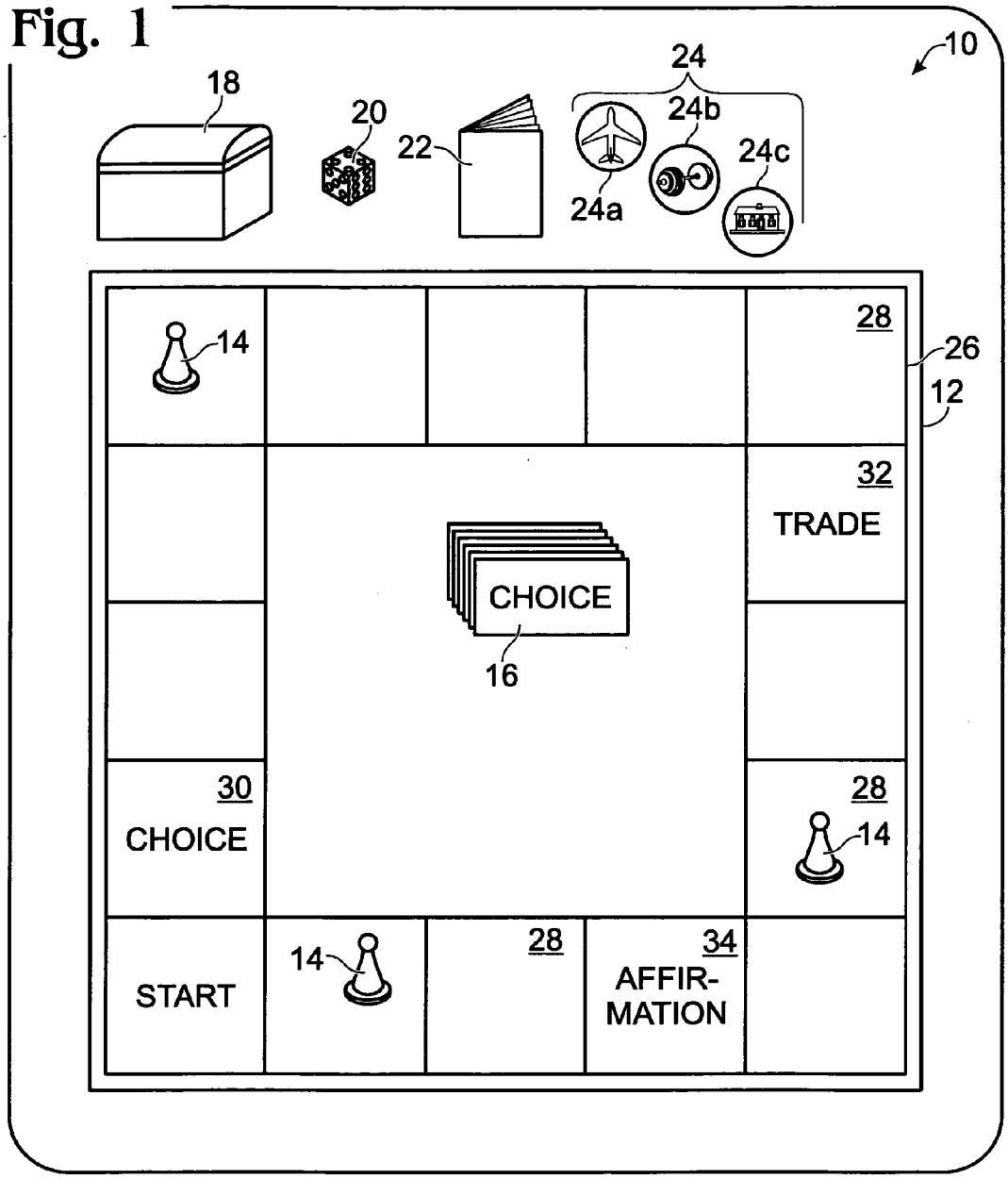
FIG. 1 is a schematic representation of a game according to one embodiment of the present invention.

Turning initially to FIG. 1, game 10 may include a game board 12, movers 14, choice cards 16, item randomizer 18, random number generator 20, rulebook 22, and items 24. Of course it will be appreciated that the depicted embodiments of the game components are exemplary and that alternative embodiments of particular components may be contemplated by the present invention.

Game board 12 may include a continuous path 26 subdivided into a plurality of spaces 28. A subset of the spaces may include words, icons, or some other indicators that allow or require one or more players to engage in particular actions. In the depicted embodiment, the game board may include one or more choice space 30, trade space 32, and/or affirmation space 34, each of which may suggest or require a different corresponding action to be performed by the player whose mover lands on one of these spaces.

Figure 2:
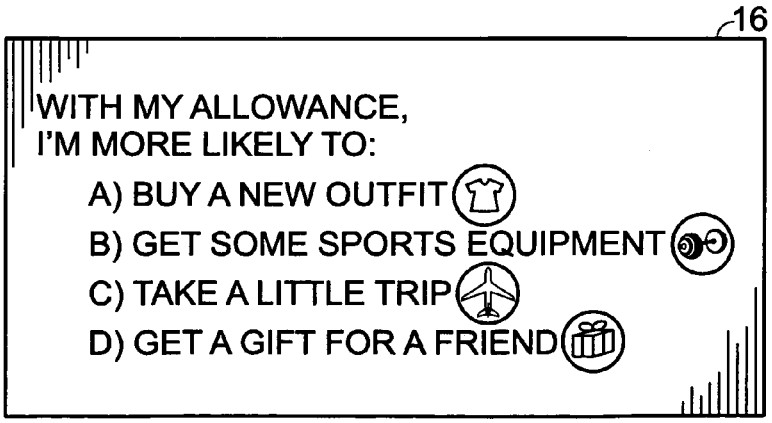
FIG. 2 depicts a choice card suitable for use with the game of FIG. 1.

For example, in accordance with one set of rules suitable for use with the presently described game, if a player lands on a choice space 30, the person to his or her left may draw a choice card 16 and read aloud a multiple-choice question presented on the card. An exemplary choice card 16 is shown in FIG. 2.

The player who has landed on the choice space must then answer the question presented and may collect one of various items 24 reflecting the answer given. As shown, exemplary items may include those reflective of travel (i.e. item 24*a*), those reflective of athletics (i.e. item 24*b*), and/or those reflective of home and family (i.e. item 24*c*).

Additionally or alternatively, the rules may state that a player who lands on a trade space 32 may barter for an item 24 collected by any other player. Typically, players will want to collect items that they believe represent their own interests, ideals, or desires.

Moreover, if a player lands on an affirmation space 34, the rules may state that the player landing on the affirmation space may or must read aloud an affirmation that is printed on the board.

The rules may state that the game ends once any player has circled the board a predetermined number of times, typically two, three, or four times. Once the game ends, a player (for example the first player to circle the board the predetermined number of times) may place all of his or her collected items 24 into the item randomizer 18, which make take the form of a box, chest, trunk, container, or the like, and mix the collected items 24 inside (i.e. by shaking the container). The player may then remove a predetermined number of items 24, typically at random, one at a time, and look up the combination in rulebook 22. The corresponding passage in the booklet may be phrased as an individualized fortune. Remaining players may then repeat this process with their individual collections of items 24 to receive their own individualized fortunes.

The following paragraphs depict one possible commercial implementation of this embodiment.

Number of players: 2–4

Game Contents:

1 Board

150 Choice Cards

1 Item randomizer (i.e. Memento Chest)

80 Items (i.e. Mementos)

4 Movers

1 Random number generator (i.e. 6-Sided Die)

1 Vac Tray

1 Destiny Index (Printed Booklet)

Game Set Up:

Unfold the game board.

Place the game board in the middle of the playing area.

Shuffle the Choice cards and place them on the designated space on the board.

The Mementos should stay in their compartments in the vac tray and be taken out as they are needed.

The Memento Chest can be placed to the side for the beginning portion of the game.

Each player should select a colored mover to represent her and place it at the start space on the board.

Object:

Discovering how your choices and life's chances affect the outcome of your life! This will be determined by how players answer questions as they travel down life's path. At the end, players will load the mementos they've gathered throughout the game (based on how they answer) into the Memento Chest. The order in which they are extracted will determine what kind of life they have chosen, as explained in an accompanying chart or key.

Rules of Play:

Youngest player goes first.

Begin by rolling the die and moving the number of spaces it shows. There are several types of spaces you may land on:

Affirmation Space: If you land on this space you can read aloud the affirmation printed on the board. Your turn is now over, and play continues in a clock-wise order.

Choice Spaces: If you land on a choice space, the player to the left will draw a Choice Card and read it out loud. These cards ask you to answer a multiple-choice question. You will have to pick between four different choices to select the answer that most fits you and your life.

For Example, a possible "Choice" card question might be: "With my allowance, I'm more likely to a) buy a new outfit b) get some sports equipment c) take a little trip d) get a gift for a friend"

What you answer will determine which Memento you receive. (A symbol of the appropriate memento will be shown next to the answer on the card.) After you receive the memento, your turn is over. Play continues in a clock-wise order.

NOTE: Some "Choice" cards will have a "none of the above" choice. If the player feels that none of the other answers represent their life, they can choose d) none of the above. They must then explain what their answer would be. It is up to the player who read the card to decide if the answer is sincere. If so, that player can collect any memento of their choice! Be nice, it could happen to you next!

Chance Space: If you land on a space labeled "Chance" you have the opportunity to trade mementos with other players. Decide what memento you want more of, or try to get one that you don't already have, after all, life is about balance! Start by telling a player what memento of theirs you would like. Then ask them what they would want in return. Don't be afraid to barter, you may need to give up two of yours to get the one you really want!

NOTE: Only the player who landed on the "Chance" space may trade. One trade per turn, but they can ask as many players as they want. Other players can also try to make offers to attract the "Choice" Space player's attention. Once the trade is over it is the next player's turn. Play continues in a clock-wise order.

After the first player has traveled around the board 3 times, the game is over.

Scoring:

The first player to travel around the board 3 times is the first to load their mementos into the "Memento Chest". Once all of a single player's mementos are inside, shake the chest, mixing up the mementos inside. Sometimes life can shake you up and affect your choices!

The player then opens the chest and takes out four mementos, one at a time, and places them in front of them in the order in which they were extracted. For example, they might have pulled out one memento for travel, two for fitness & health, and one for career & home. They then look up that combination in the destiny index, in which they are able to read, for example, that based on the choices and chances they will face in life they are likely to become:

"A world traveling fitness instructor, whose clients include international film stars!"

Players then take a turn using the memento chest and looking up their destinies in the destiny index.

NOTE: The memento chest helps provide a random element for the game experience. Since players are likely to answer the questions in the same way (based on their personality) the memento chest will work to add variety as to what particular mementos work to affect your life destiny each time you play. This will help the repeat play value of this game.

Winning:

It's not how you win or lose, but how you play the game! This game is about discovering who you are and what life has in store for you. Have fun learning about your friends. After all, life doesn't have to be about competition, it's about choices!

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A method for playing a game, the method comprising:

providing a game board including a continuous path subdivided into a plurality of spaces, wherein the spaces include at least one choice space;

moving a playing piece around the game board;

collecting personalized items by:

landing on a choice space;

drawing a choice card;

providing an answer to a question on the choice card; and obtaining an item that correlates with the answer;

randomly selecting a subset of items collected by a first player; identifying a selection order for each item in the subset of items; and comparing the selected items and their corresponding selection orders to a destiny index to determine a fortune for the player.

2. The method of claim 1 wherein the spaces include at least one affirmation space.

3. The method of claim 2 wherein upon landing on an affirmation space a player must read an affirmation corresponding to the affirmation space.

4. The method of claim 1 wherein the spaces includes at least once trade space.

5. The method of claim 1 wherein upon landing on a trade space, a player may try to barter for an item in the possession of another player.

6. The method of claim 1 where the choice cards include a question and a series of multiple-choice answers.

7. The method of claim 6 where at least some of the multiple-choice answers are each correlated with a specific item.

8. The method of claim 7 where one of the multiple-choice answers is not correlated with a specific item.

9. The method of claim 8 where a player who selects the multiple-choice answer that is not correlated with a specific item must provide his or her own answer.

10. The method of claim 9 where after answering the multiple choice answer that is not correlated with a specific item, the player may then select an item of his or her choice.

11. A method of determining a player's fortune by playing a game, the method comprising:

providing a game board with a continuous path subdivided into a plurality of spaces, where the spaces include at least one choice space, at least one affirmation space, and at least one trade space;

providing a random number generator, providing a plurality of items;

providing an item randomizer;

providing a plurality of movers;

moving the movers around the game board in response to the random number generator; and upon landing on a choice space:

drawing a card;

reading a question on the card;

selecting an answer; and selecting an item reflective of the answer;

upon landing on an affirmation space, reading an affirmation;

upon landing on a trade space, optionally bartering for an item in another player's possession; and upon finishing the game:

randomizing the items collected by a player;

obtaining a subset of the randomized items; and identifying a fortune for the player based on the subset obtained.

12. The method of claim 11 wherein finishing the game comprises traveling completely around the game board a predetermined number of times.

13. The method of claim 12 where the predetermined number is three.

14. The method of claim 11 where the steps of randomizing the items and obtaining a subset of the randomized items includes:

placing the items collected by the player in an item container;

shaking the container; and withdrawing a subset of the items from the container.

15. The method of claim 14 where the subset is four items.

16. The method of claim 11 where the step of identifying a fortune for the player based on the subset obtained includes determining the order in which the subset of randomized items was obtained.

* * * * *